US009528398B2

(12) United States Patent
Jeon et al.

(10) Patent No.: US 9,528,398 B2
(45) Date of Patent: Dec. 27, 2016

(54) VARIABLE VALVE LIFT APPARATUS

(71) Applicant: HYUNDAI MOTOR COMPANY, Seoul (KR)

(72) Inventors: Jae Hee Jeon, Hwaseong-si (KR); Seock Joong Yoon, Hanam-si (KR)

(73) Assignee: Hyundai Motor Company, Seoul (KR)

( * ) Notice: Subject to any disclaimer, the term of this patent is extended or adjusted under 35 U.S.C. 154(b) by 100 days.

(21) Appl. No.: 14/558,398

(22) Filed: Dec. 2, 2014

(65) Prior Publication Data

US 2016/0076407 A1 Mar. 17, 2016

(30) Foreign Application Priority Data

Sep. 16, 2014 (KR) ..... 10-2014-0122745

(51) Int. Cl.

| | |
|---|---|
| ***F01L 9/02*** | (2006.01) |
| ***F01L 1/24*** | (2006.01) |
| ***F01L 1/18*** | (2006.01) |
| ***F01L 1/047*** | (2006.01) |

(52) U.S. Cl.

CPC ..... *F01L 1/2411* (2013.01); *F01L 1/047* (2013.01); *F01L 1/185* (2013.01)

(58) Field of Classification Search

CPC ..... F01L 1/047; F01L 1/185; F01L 1/2411

USPC ..... 123/90.12, 90.13, 90.39, 90.44

See application file for complete search history.

(56) References Cited

U.S. PATENT DOCUMENTS

| | | | | |
|---|---|---|---|---|
| 6,732,685 | B2 * | 5/2004 | Leman | F01L 9/02 123/198 F |
| 8,434,451 | B2 * | 5/2013 | Yoon | F01L 1/181 123/321 |

FOREIGN PATENT DOCUMENTS

| | | | |
|---|---|---|---|
| JP | 2006-097534 | A | 4/2006 |
| JP | 2007-040238 | A | 2/2007 |
| JP | 4021730 | B2 | 12/2007 |
| KR | 10-0238126 | B1 | 1/2000 |
| KR | 10-2000-0073250 | A | 12/2000 |
| KR | 10-0566648 | B1 | 3/2006 |
| KR | 10-2007-0006681 | A | 1/2007 |
| KR | 10-2011-0033542 | A | 3/2011 |
| WO | 2010/078280 | A2 | 7/2010 |

OTHER PUBLICATIONS

Yoon et al., Engine Brake Unit Having Combined Oil Passage, US Patent Application Pub. No. US 2011/0073068 A1, Mar. 31, 2011.*

(Continued)

*Primary Examiner* — Ching Chang

(74) *Attorney, Agent, or Firm* — McDermott Will & Emery LLP

(57) ABSTRACT

A variable valve lift apparatus includes a rocker arm having a rocker arm shaft penetrating therethrough. One portion of the rocker arm is supported by a cam shaft and another portion thereof contacts an upper end of an intake valve or an exhaust valve to open and close the intake valve or the exhaust valve. An actuator is disposed at an end of the rocker arm and protrudes toward the intake valve or the exhaust valve depending on an oil pressure applied to change an opening of the intake valve or the exhaust valve. A control valve applies the oil pressure to the actuator to maintain an opened state of the intake valve or the exhaust valve when the intake valve or the exhaust valve is closed.

8 Claims, 6 Drawing Sheets

(56) References Cited

OTHER PUBLICATIONS

Korean Office Action mailed on May 28, 2015, issued in corresponding Korean Patent Application No. 10-2014-0122745; 3 pages in Korean language.

* cited by examiner

VARIABLE VALVE LIFT APPARATUS

CROSS REFERENCE TO RELATED APPLICATION

The present application claims the benefit of priority to Korean Patent Application No. 10-2014-0122745, filed on Sep. 16, 2014, the entire contents of which is incorporated herein for all purposes by this reference.

TECHNICAL FIELD

The present disclosure relates to a variable valve lift apparatus, and more particularly, to a variable valve lift apparatus capable of independently controlling each of intake valves or exhaust valves which are configured in pair.

BACKGROUND

A commercial vehicle such as a truck or a bus is generally equipped with an engine having a high displacement. Since the commercial vehicle has the engine displacement higher than that of a passenger car, inlet and outlet ports need to have a sufficient size for a smooth gas flow which is instantly input to and output from a cylinder of the engine.

For this reason, a typical engine of the commercial vehicle uses a valve lifting method based on a center pivot scheme, in which the center pivot scheme is a type of simultaneously opening or closing a pair of intake valves or a pair of exhaust valves by one rocker arm.

The center pivot scheme may simultaneously open and close two valves to instantly input and output a large amount of air to and from the cylinder, and therefore is suitable for an engine having a high displacement.

However, the typical center pivot scheme may simultaneously operate a pair of valves but limits independent valve operations, and therefore has a difficulty in controlling a valve opening amount.

The matters described as the related art have been provided only for assisting in the understanding for the background of the present disclosure and should not be considered as corresponding to the related art known to those skilled in the art.

SUMMARY

An aspect of the present inventive concept provides a variable valve lift apparatus including an actuator which presses a plurality of valves to independently open the valves.

According to an exemplary embodiment of the present inventive concept, a variable valve lift apparatus includes a rocker arm having a rocker arm shaft penetrating therethrough. One portion of the rocker arm is supported by a cam shaft, and another portion thereof contacts an upper end of an intake valve or an exhaust valve to open and close the intake valve or the exhaust valve. An actuator is disposed at an end of the rocker arm and protrudes toward the intake valve or the exhaust valve depending on an oil pressure applied to change an opening of the intake valve or the exhaust valve. A control valve applies the oil pressure to the actuator to maintain an opened state of the intake valve or the exhaust valve when the intake valve or the exhaust valve is closed.

One end of the rocker arm may be provided with a chamber of which one side is opened toward the intake or exhaust valve so that the actuator is inserted into the chamber and may be further provided with a supply channel which connects the chamber to a control valve to supply an oil into the chamber depending on an operation of the control valve.

The actuator may include a housing having an opened one side opposite to another side of the chamber, and another side of the housing contacting the intake valve or the exhaust valve. A support rod has one end coupled with the other side of the chamber, and another end of the support rod is disposed inside the housing. A cover covers one side of the housing and is coupled with the housing. An elastic member has one end supporting the other end of the support rod inside the housing, and another end of the elastic member contacts the cover to press the housing and the cover upwardly.

The oil may be supplied to a space between the other side of the chamber and the cover at the time of pressing the actuator to press the housing in one direction in which the chamber is opened.

The variable valve lift apparatus may further include a discharge channel through which the oil supplied to the chamber is discharged to outside. A connection channel is extended from the supply channel to connect an end thereof to the discharge channel. A valve means closes the discharge channel and the connection channel depending on the oil pressure applied to the supply channel.

The valve means may be formed at an end of the connection channel. When the oil pressure of the connection channel is equal to or more a set pressure, the valve means may be a first check valve protruding toward the discharge channel to open the connection channel and the discharge channel and close the discharge channel.

The supply channel between an extending point of the connection channel and the chamber may be further provided with a second check valve opening or closing depending on the applied oil pressure.

The intake valve or the exhaust valve may be formed in pair, a bridge having both ends each connected to one end of the pair of intake valves or the pair of exhaust valves may be provided, and a central portion of the bridge may be elastically coupled with an end of the rocker arm adjacent the actuator.

The actuator may protrude toward any one of the pair of intake valves or the pair of exhaust valves when the oil pressure is applied.

The rocker arm may open and close the exhaust valve.

The control valve may be a solenoid valve and may be connected to an oil pump to apply the oil pressure to the actuator at the time of an intake stroke.

BRIEF DESCRIPTION OF THE DRAWINGS

The above and other objects, features and advantages of the present disclosure will be more clearly understood from the following detailed description taken in conjunction with the accompanying drawings.

DETAILED DESCRIPTION

Hereinafter, a variable valve lift apparatus according to exemplary embodiments of the present inventive concept will be described with reference to the accompanying drawings.

Figure 1:
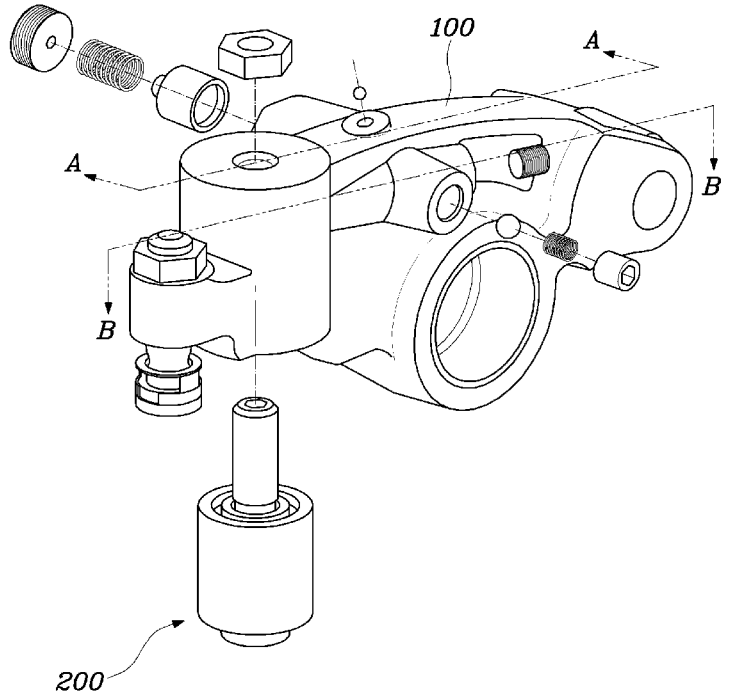
FIG. 1 is a view showing a variable valve lift apparatus according to an exemplary embodiment of the present inventive concept.

FIG. 1 is a view showing a variable valve lift apparatus according to an exemplary embodiment of the present inventive concept, in which the variable valve lift apparatus includes a rocker arm 100 configured to have a rocker arm shaft penetrating therethrough and have one portion supported by a cam shaft (not illustrated) and the other portion contacting an upper end of an intake valve or an exhaust valve to open and close the intake valve or the exhaust valve. An actuator 200 is disposed at an end of the rocker arm 100 and protrudes toward the intake valve or the exhaust valve depending on an oil pressure to change an opening of the intake valve or the exhaust valve. A control valve 300 (see FIG. 4) applies the oil pressure to the actuator 200 to maintain an opened state of the intake valve or the exhaust valve when the intake valve or the exhaust valve is closed.

In detail, the rocker arm 100 has a rocker arm shaft ('101' in FIG. 4) for rotating the rocker arm 100 inserted into a central portion thereof and has one end toward the intake valve or the exhaust valve and the other end contacting a cam ('500' in FIG. 7) rotating by engine power so that the rocker arm 100 may move in a seesaw form depending on the rotation of the cam. The rocker arm 100 may open and close the exhaust valve or the intake valve and suck some of exhaust gas into a combustion chamber to improve ignitionability. Therefore, according to the exemplary embodiment of the present inventive concept, the exhaust valve or the intake valve will be described. However, the components and components to be described below and the operation processes of the components may be similarly applied to the intake valve as well as may be applied to both of the intake valve and the exhaust valve.

Figure 2:
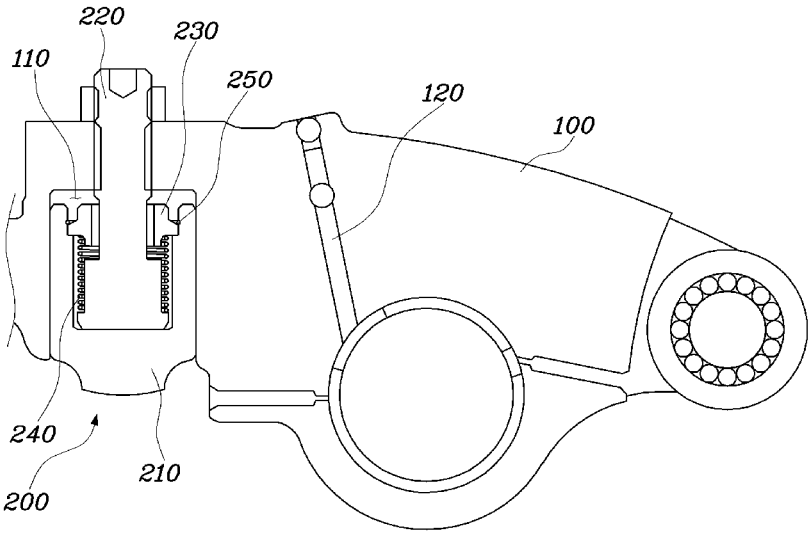
FIG. 2 is a cross-sectional view taken along the A-A of FIG. 1.

FIG. 2 is a cross-sectional view taken along the A-A of FIG. 1, in which one end of the rocker arm 100 is provided with a chamber 110 of which one side is opened toward the valve so that the actuator 200 is inserted into the chamber 110 and may be further provided with a supply channel 120 which connects the chamber 110 to a control valve 300 so as to supply an oil into the chamber 110 depending on an operation of the control valve 300.

An outer circumferential surface of the actuator 200 adheres to an inner circumferential surface of the chamber 110, and thus, when the oil is supplied into the chamber 110, the actuator 200 is pressed to protrudedly slide toward the exhaust valve, and when the oil inside the chamber 110 is removed, the actuator 200 may be again inserted into the chamber 110.

Figure 3:
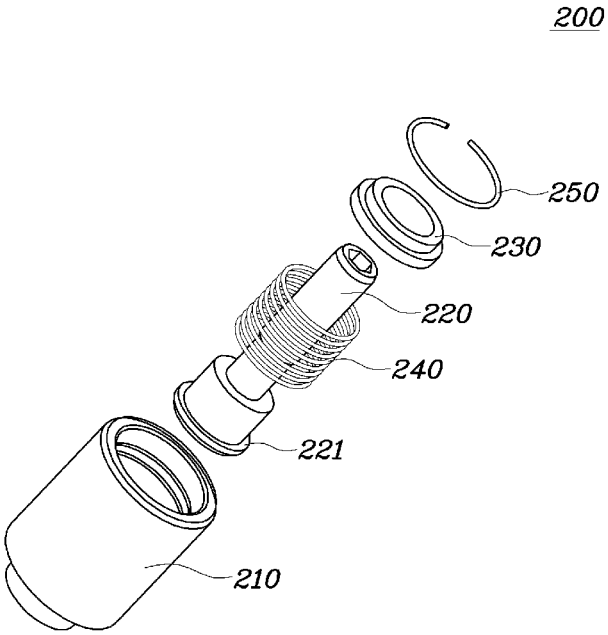
FIG. 3 is a view illustrating an actuator of a variable valve lift apparatus according to an exemplary embodiment of the present inventive concept.

FIG. 3 is a view illustrating the actuator of the variable valve lift according to the exemplary embodiment of the present inventive concept. Hereinafter, the actuator 200 will be described in detail with reference to FIGS. 2 and 3. The actuator 200 may include a housing 210 which has an opened one side opposite to another side of the chamber 110 and the other side contacting the exhaust valve. A support rod 220 has one end coupled with the other side of the chamber 110 and the other end disposed inside the housing 210. A cover 230 covers one side of the housing 210 and be coupled with the housing 210. An elastic member 240 has one end supporting another end of the support rod 220 inside the housing 210, and another end of the elastic member 240 contacts the cover 230 to press the housing 210 and the cover 230 upwardly.

An inside of the housing 210 is provided with a space which communicates with outside through the opened one side of the housing 210 and an outer circumferential surface of the housing 210 may slide while contacting the inner circumferential surface of the chamber 110.

The one end of the support rod 220 may be fastened with the rocker arm 100 corresponding to the other side of the chamber 110 inside the chamber 110 by bolting, welding, bonding, or the like, but the exemplary embodiment of the present inventive concept is not necessarily limited thereto, and a circumference of the other end of the support rod 220 may be provided with a protrusion 221 to support the one end of the elastic member 240.

The cover 230 covers the one side of the opened housing 210 and may have a central portion provided with a hole to allow the support rod 220 penetrate through the central portion. An outer circumferential surface of the cover 230 may slide while contacting the inner circumferential surface of the housing 210. The circumference of the cover 230 is provided with a snap ring 250 to prevent the cover 230 from separating due to the elastic member 240. The inner circumferential surface of the housing 210 may be provided with a fitting groove to fit the snap ring 250 thereon so that the snap ring 250 is coupled with the housing 210. The elastic member 240 may be a spring but is not necessarily limited thereto.

Further, the oil is supplied to the space between the other side of the chamber 110 and the cover 230 at the time of pressing the actuator 200 to press the housing 210 to one end direction to which the chamber 110 is opened. To this end, the supply channel 120 may be formed to communicate with the space between the other side of the chamber 110 and the cover 230.

According to the foregoing configuration, when the oil is supplied into the chamber 110 through the supply channel 120 to pressurize, the housing 210 and the cover 230 are pressed to allow the other end of the housing 210 protrude toward the exhaust valve at the outside of the rocker arm 100 by overcoming the elastic force of the elastic member 240. When the oil supply stops, and oil is discharged to remove the pressure, the cover 230 is pressed by a restoring force of the elastic member 240 and the housing 210 coupled with the cover 230 is inserted into the chamber 110 by the snap ring 250.

Further, due to the foregoing configuration, the easiness of the assembling may be improved, and the actuator 200 is separately manufactured and then may be inserted into the chamber 110, and therefore, the manufacturing may be simplified.

Figure 4:
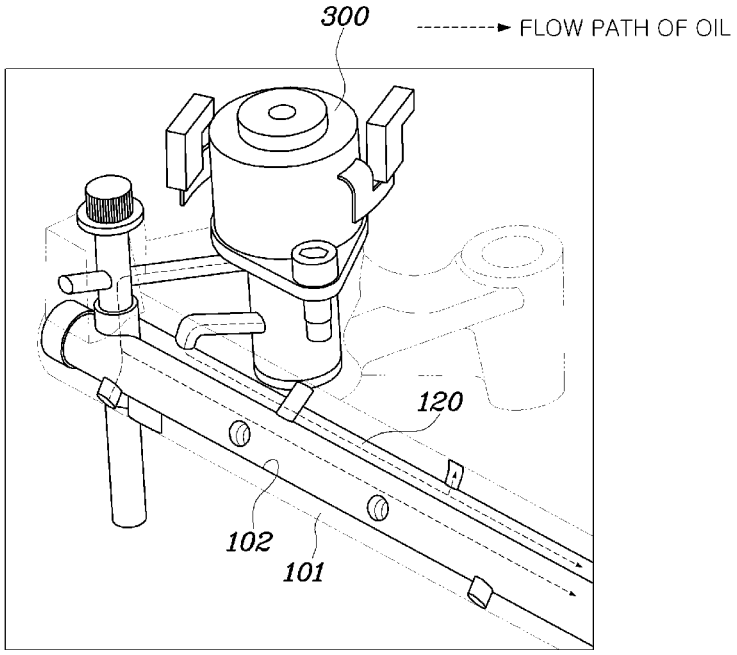
FIG. 4 is a view illustrating a control valve according to an exemplary embodiment of the present inventive concept.

The flowing process of oil will be described with reference to FIG. 4. FIG. 4 is a view illustrating the control valve 300 according to an exemplary embodiment of the present inventive concept. The rocker arm shaft 101 inserted into the rocker arm has a hollow 102 formed therein, and thus, an oil supplied from an oil pump (not shown) is supplied to a cylinder head along the hollow 102 formed inside the rocker arm shaft 101 and the inside of the rocker arm shaft 101 may also be provided with the supply channel 120 separately from the hollow 102.

The rocker arm shaft 101 may be coupled with the plurality of rocker arms, and one end of the rocker arm shaft 101 may be provided with the control valve 300, in which the control valve 300 is a solenoid valve and is connected to the hollow 102 and one end of the supply channel 120, respectively and permits or interrupts the oil supply from the hollow 102 to the supply channel 120 to supply or interrupt the oil supply to the supply channel 120.

Here, even though the supply channel 120 may be formed at the outside of the rocker arm shaft 101 through a separate pipeline in addition to the inside of the rocker arm shaft 101, the supply channel 120 is formed inside the rocker arm shaft 101 to simplify a layout, thereby saving production cost and simplifying the process.

As illustrated in FIG. 2, the supply channel 120 formed along the rocker arm shaft 101 may also be formed inside the rocker arm 100 so that the other end of the supply channel 120 may be continued to the chamber 110.

Figure 5:
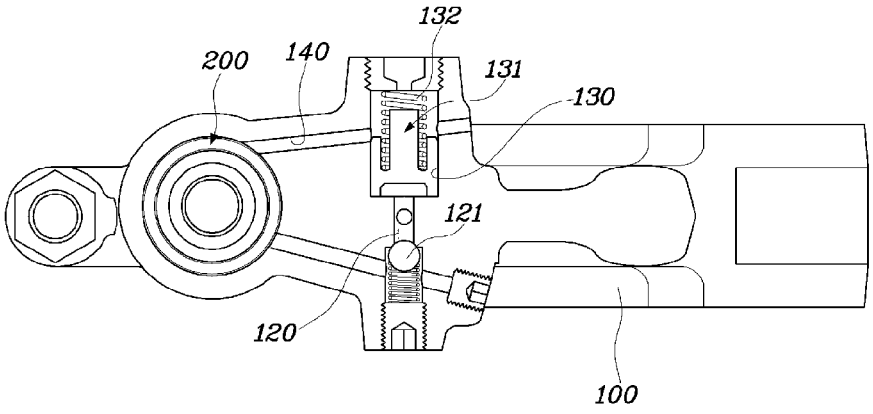
FIG. 5 is a cross-sectional view taken along the B-B of FIG. 1.
Figure 6:
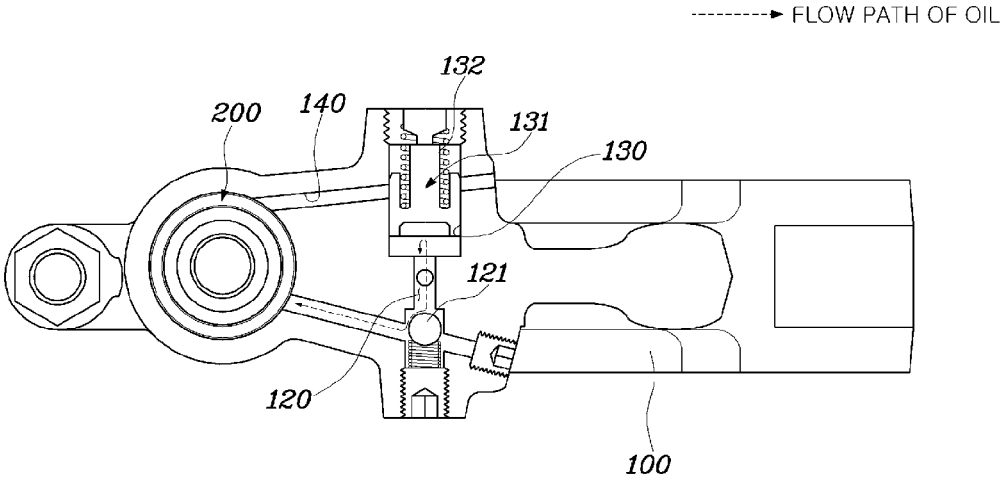
FIG. 6 is a view illustrating a state in which oil pressure is applied, in the cross-sectional view taken along the B-B of FIG. 1.

FIG. 5 is a cross-sectional view taken along the B-B of FIG. 1, and FIG. 6 is a view illustrating a state in which oil pressure is applied. In the cross-sectional view taken along the B-B of FIG. 1, a discharge channel 140 through which the oil supplied to the chamber 110 is discharged to the outside is formed. A connection channel 130 is extended from the supply channel 120 to connect an end thereof to the discharge channel 140. A valve means 131 closes the discharge channel 140 and the connection channel 130 depending on the oil pressure applied to the supply channel 120.

The supply channel 120, the discharge channel 140, and the connection channel 130 may also be provided at the outside of the rocker arm 100 in a separate pipe form or may be formed inside the rocker arm 100. The layout may be simplified and the easiness of the manufacturing may be increased.

The valve means 131 is formed at an end of the connection channel 130. When the oil pressure of the connection channel 130 is equal to or more a set pressure, the valve means 131 may be a first check valve protruding to the discharge channel 140 opens the connection channel 130 and the discharge channel 140 and closes the discharge channel 140. Further, the valve means 131 may be a motor driving valve including a motor which is operated by a separate control, and in addition to this, various types of valves may be applied. The valve means 131 may be a check valve which is pressed and operated by an elastic body such as a spring, which simplifies the configuration and improves durability.

An end of the connection channel 130 may be formed to have a cross sectional area larger than that of the rest portion of the connection channel 130. The valve means 131 may maintain airtightness by attaching an outer circumferential surface of the valve means 131 to an inner circumferential surface of the end of the connection channel 130. The valve means 131 may slide in a longitudinal direction of the connection channel 130 from the end of the connection channel 130. The discharge channel 140 may be opened when it is maximally inserted into the connection channel 130 to provide the oil flow. The oil pressure of the connection channel 130 is increased to stop the discharge channel 140 when a portion of the valve means 131 protrudes to the discharge channel 140 so as to stop both of the discharge channel 140 and the connection channel 130, such that the oil moves only to the supply channel 120 to fill the chamber 110 but is prevented from exiting through the discharge channel 140. An elastic body 132 which presses the valve means 131 into the connection channel 130 may be further provided, and the pressure may be set by performing an experiment several times depending on the elastic force of the elastic body 132.

The valve means 131 stops the end of the connection channel 130 to prevent the connection channel 130 from communicating with the discharge channel 140 at all times, but the discharge channel 140 may be opened when the supplied pressure is not sufficient.

Further, the supply channel 120 between an extending point of the connection channel 130 and the chamber 110 may be further provided with a second check valve 121 which is opened or closed depending on the applied oil pressure.

The second check valve 121 may be operated at an operating pressure different from or equal to that of the valve means 131. If the oil pressure is applied in the early stage, the pressure to the connection channel 130 is rapidly increased to allow the valve means 131 to interrupt the discharge channel 140 before the oil is discharged to the discharge channel 140 through the chamber 110.

The oil reversely exits through the supply channel 120 at the release of the oil pressure. In this case, the second check valve 121 is closed, and the valve means 131 opens the discharge channel 140 to discharge the oil inside the chamber 110 to the outside.

FIGS. 7 to 10 are views sequentially illustrating an operation process of a variable valve lift apparatus according to an exemplary embodiment of the present inventive concept. The exhaust valve 400 is formed in pair. A bridge 410 has each of both ends connected to one end of the pair of exhaust valves 400. A central portion of the bridge 410 may be elastically coupled with an end of the rocker arm 100 adjacent the actuator 200.

In detail, an end of the one end of the bridge 410 may be provided with an elastic member having a ball hinge structure or rubber to be elastically coupled with the bridge 410, and any one of the pair of exhaust valves 400 is eccentrically opened and closed due to the elastic coupling at the time of being pressed so that the exhaust valve 400 may be variably opened and closed.

The actuator 200 may be provided between the central portion of the rocker arm 100, and the end of the one end of the rocker arm 100 and any one of the exhaust valves 400 may be disposed to correspond to the actuator 200.

The control valve 300 is connected to the oil pump and may be opened to apply the oil pressure to the actuator at the time of the intake stroke. As some of the exhaust valves are opened at the time of the intake stroke, some of the exhaust gas may be again introduced into a combustion chamber, and a temperature inside the combustion chamber is increased to prevent non-ignition and to improve the stability of ignition, thereby improving the startability and increasing the combustion efficiency. The control valve 300 may be controlled by driving the engine through a separate controller (not illustrated).

Figure 7:
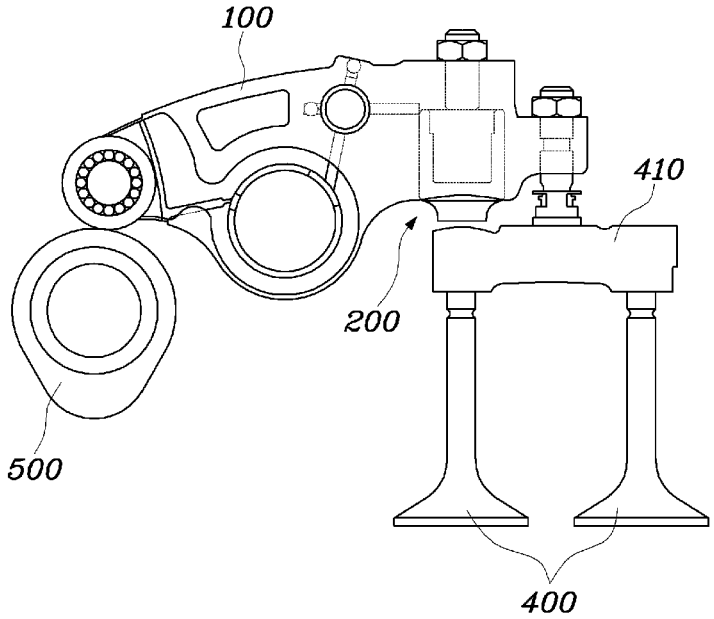
FIGS. 7 to 10 are views sequentially illustrating an operation process of a variable valve lift apparatus according to an exemplary embodiment of the present inventive concept.
Figure 8:
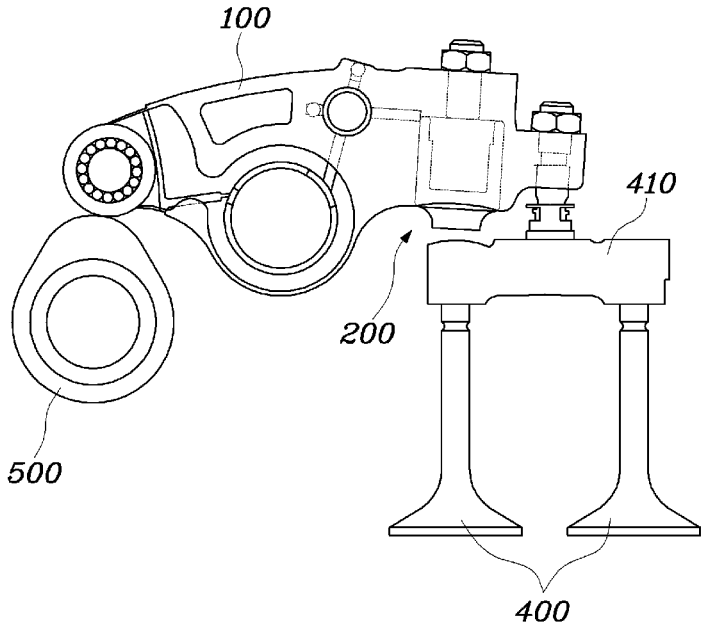

In connection with this, the operation process of the variable valve lift apparatus according to the exemplary embodiment of the present inventive concept will be described with reference to FIGS. 7 to 10. FIG. 7 illustrates a state in which the exhaust valve 400 is currently closed and a piston of the engine is disposed at a top dead center or near the top dead center, after an explosion stroke and before an exhaust stroke. Next, as illustrated in FIG. 8, the exhaust stroke is performed, and thus, the rocker arm 100 moves in a seesaw form depending on the rotation of the cam 500 so that the exhaust valve 400 falls to be opened and maintains a maximally opened state at a bottom dead center or near the bottom dead center.

Figure 9:
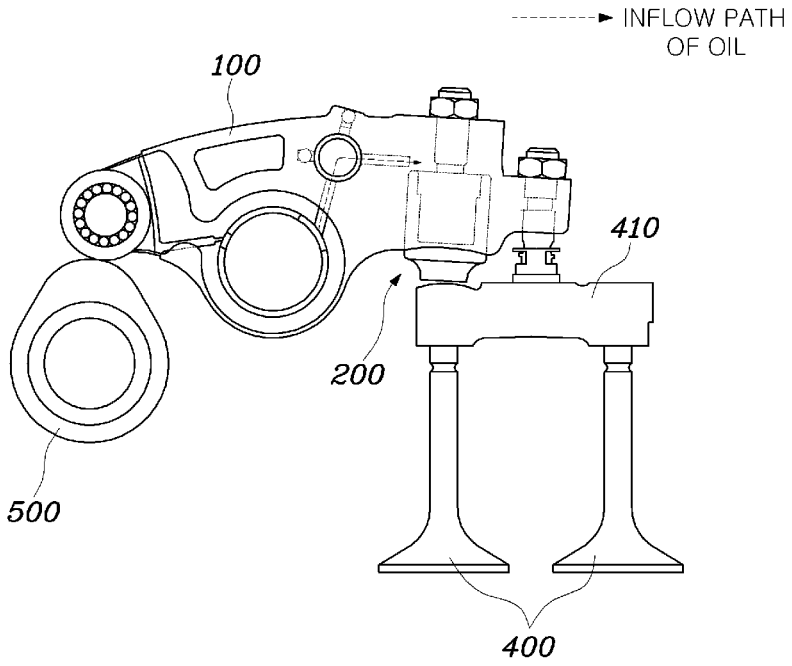
Figure 10:
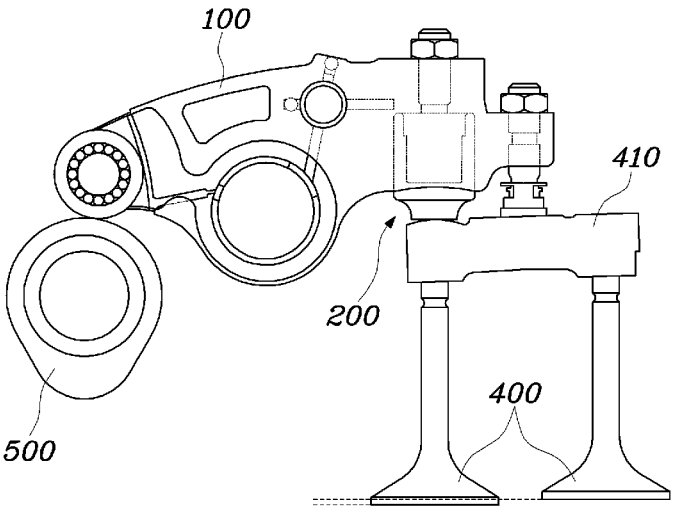

Referring to FIG. 9, the control valve 300 (see FIG. 4) is opened near the bottom dead point of the piston to supply the oil, and the oil pressure is applied to the chamber to allow the actuator 200 to protrude toward the exhaust valve 400.

When the intake stroke is performed and thus the exhaust valve 400 rises, the exhaust valve 400 contacting the actuator 200 among the pair of exhaust valves 400 is incompletely closed by the actuator 200 and is in the opened state in advance while maintaining a set interval from the rest exhaust valve 400 by an experiment.

That is, the pair of exhaust valves 400 are controlled to show different open degrees, and thus, the variable exhaust valve may be controlled and a portion of the exhaust valve 400 is opened at the time of the intake stroke to increase the temperature in the combustion chamber so as to prevent the non-ignition and improve the stability of ignition, thereby improving the startability and increasing the combustion efficiency.

As described above, according to the variable valve lift apparatus having the foregoing structure, it is possible to prevent non-ignition and improve the stability of ignition by opening the exhaust valve for a period of the intake stroke to induce the increase in temperature inside the combustion chamber.

According to the variable valve lift apparatus having the foregoing structure, it is possible to finely control the opening of the valve by independently controlling the intake valve or the exhaust valve.

Further, it is possible to rapidly and accurately control the intake valve or the exhaust valve based on the operation method using the oil pressure.

Although the present inventive concept has been shown and described with respect to specific exemplary embodiments, it will be obvious to those skilled in the art that the present inventive concept may be variously modified and altered without departing from the spirit and scope of the present invention as defined by the following claims.

What is claimed is:

1. A variable valve lift apparatus, comprising:

a rocker arm having a rocker arm shaft penetrating therethrough, one portion of the rocker arm supported by a cam shaft and another portion of the rocker arm contacting an upper end of an intake valve or an exhaust valve to open and close the intake valve or the exhaust valve;

a valve actuator disposed at an end of the rocker arm and protruding toward the intake valve or the exhaust valve depending on an oil pressure to change an opening of the intake valve or the exhaust valve;

a control valve configured to apply the oil pressure to the valve actuator to maintain an opened state of the intake valve or the exhaust valve;

a discharge channel through which the oil supplied to a chamber is discharged to outside;

a connection channel extending from a supply channel to connect an end thereof to the discharge channel; and a first check valve for closing the discharge channel and the connection channel depending on the oil pressure applied to the supply channel, wherein the first check valve is disposed at the end of the connection channel so that when the oil pressure of the connection channel is equal to or more a set pressure, and wherein the supply channel between an extending point of the connection channel and the chamber has a second check valve opening or closing depending on the applied oil pressure.

2. The variable valve lift apparatus of claim 1, wherein the chamber is connected to one end of the rocker arm and has one side opened toward the intake or exhaust valve so that the valve actuator is inserted into the chamber, wherein the rocker arm has a supply channel which connects the chamber to the control valve to supply an oil into the chamber by an operation of the control valve.

3. The variable valve lift apparatus of claim 2, wherein the valve actuator includes:

a housing having an opened one side opposite to another side of the chamber, and another side of the housing contacting the intake valve or the exhaust valve;

a support rod having one end coupled with another side of the chamber, and another end of the support rod disposed inside the housing;

a cover covering one side of the housing and coupled with the housing; and an elastic member having one end supporting the other end of the support rod inside the housing, and another end of the elastic member contacting the cover to press the housing and the cover upwardly.

4. The variable valve lift apparatus of claim 3, wherein the oil is supplied to a space between the chamber and the cover when pressing the valve actuator to press the housing in one direction in which the chamber is opened.

5. The variable valve lift apparatus of claim 1, wherein the intake valve or the exhaust valve is formed in pair, further comprising:

a bridge having both ends connected to one end of the pair of exhaust valves or the pair of exhaust valves, respectively; and a central portion of the bridge elastically coupled with the one end of the rocker arm adjacent the valve actuator.

6. The variable valve lift apparatus of claim 5, wherein the valve actuator protrudes toward one of the pair of intake valves or the pair of exhaust valves when the oil pressure is applied.

7. The variable valve lift apparatus of claim 1, wherein the rocker arm opens and closes the exhaust valve.

8. The variable valve lift apparatus of claim 7, wherein the control valve is a solenoid valve and is connected to an oil pump to apply the oil pressure to the valve actuator during an intake stroke.

* * * * *